US005507166A

United States Patent [19]

Orlick et al.

[11] Patent Number: 5,507,166

[45] Date of Patent: Apr. 16, 1996

[54] APPARATUS FOR STRIPPING WORKPIECES

[75] Inventors: Charles A. Orlick, Littleton; Roger A. Hahn, Golden, both of Colo.

[73] Assignee: Coors Brewing Company, Golden, Colo.

[21] Appl. No.: 294,320

[22] Filed: Aug. 23, 1994

[51] Int. Cl.[6] ..... B21D 45/00; B21D 22/00; B21D 22/21; B21J 15/24

[52] U.S. Cl. ..... 72/344; 72/349; 72/430

[58] Field of Search ..... 72/344, 345, 349, 72/430, 427

[56] References Cited

U.S. PATENT DOCUMENTS 3,203,218 8/1965 Bolt et al. ..... 72/349
3,955,394 5/1976 Kaufman et al. ..... 72/344
3,990,289 11/1976 Widmann et al. .
4,121,447 10/1978 Sniady ..... 72/344
4,606,215 8/1986 McMillin .
5,001,919 3/1991 Tuka et al. .
5,115,662 5/1992 Relich et al. .

*Primary Examiner*—Lowell A. Larson
*Assistant Examiner*—Rodney A. Butler
*Attorney, Agent, or Firm*—Klaas, Law, O'Meara & Malkin; Joseph J. Kelly

[57] ABSTRACT

Apparatus for stripping a cylindrical workpiece, such as a can body, from a cylindrical supporting device, such as a punch in a can body making machine, using a plurality of circumferentially spaced apart fingers which are mounted for radial and linear sliding movement between a non-stripping location and a stripping location.

17 Claims, 1 Drawing Sheet

APPARATUS FOR STRIPPING WORKPIECES

FIELD OF THE INVENTION

This invention relates generally to apparatus for stripping a cylindrical workpiece from a cylindrical supporting device and, more particularly, to apparatus for stripping a one-piece can body from the punch of a can body making machine during the return stroke of the punch.

BACKGROUND OF THE INVENTION

Conventional can body making machines employ a removable tool pack assembly and a removable stripper assembly which are removably mounted in a forming cavity of the machine. Conventional stripper assemblies comprise an annular ring support structure mounting a plurality of separate circumferentially spaced apart fingers to form a generally circular opening. The fingers are mounted to provide for individual pivotally radially inward or outward movement. In some instances, the fingers are resiliently urged against the outer surface of the punch during the return stroke so as to contact the leading edge of the can body to disengage it from the punch. In other instances, the fingers are located not to contact the can body on the forward stroke but then are moved to be spaced a very small distance from the outer surface of the punch so that during the return stroke of the punch the fingers contact the leading edge of the can body to disengage it from the punch. In these can body making machines, the fingers are mounted for pivotal movement.

BRIEF DESCRIPTION OF THE INVENTION

This invention provides apparatus for stripping a cylindrical workpiece, such as a can body, from a cylindrical supporting device, such as a punch in a can body making machine, wherein the stripping fingers are mounted for radial movement in a linear direction.

In a preferred embodiment of the invention, housing means are provided for supporting the apparatus circumjacent the cylindrical workpiece and the cylindrical supporting device. A plurality of fingers are provided for stripping the cylindrical workpiece from the cylindrical supporting device. Mounting means are provided for mounting each of the plurality of fingers for sliding movement that is radial and linear. Each of the plurality of fingers have an end portion, preferably arcuately shaped, so that, when the plurality of fingers are in their radially innermost location the plurality of fingers form a circle having a diameter substantially the same as but slightly less than the diameter of the cylindrical supporting device. In some instances, the end portions will contact the outer surface of the cylindrical supporting device. First moving means are provided for moving each of the plurality of fingers in a radially inward direction, and second moving means are provided for moving each of the plurality of fingers in a radially outward direction. The first moving means comprise resilient means such as a coiled spring in each of the plurality of fingers and the second moving means comprise electromagnetic means such as an electromagnetic coil. The mounting means comprise an annular base support having a radially inner portion. A plurality of circumferentially spaced apart guide members project axially outwardly from the radially inner portion to form a plurality of support surfaces between adjacent guide members. One of the plurality of fingers is mounted for radial and linear sliding movement over one of the support surfaces. Abutment means are provided and comprise an abutment surface on the radially inner portion and an abutment surface on each of the plurality of fingers. The electromagnetic coil is mounted in a recess in the base support member. An annular retaining member is mounted on the annular base support for contact by the coiled springs to urge the plurality of fingers in a radially inner direction against or adjacent the abutment means. The annular retaining member has an inner ring formed from a non-magnetic material and an outer ring formed from a magnetic material. A cover is secured to the annular base support and covers the plurality of fingers and the annular retaining member. The fingers and the base support are formed from a magnetic material. The cover is formed from a non-magnetic material.

In another preferred embodiment of the invention, the first moving means comprise electromagnetic means and the second moving means comprise electromagnetic means.

BRIEF DESCRIPTION OF THE DRAWING

Illustrative and presently preferred embodiments of the invention are illustrated in the drawing in which.

DETAILED DESCRIPTION OF THE INVENTION

Figure 3:
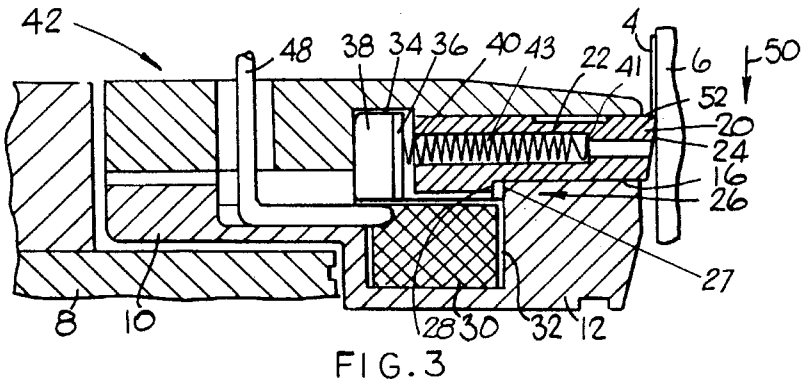
FIG. 3 is a view with parts in section of a preferred embodiment of the invention.

In the drawing, there is illustrated apparatus 2 for stripping a generally cylindrical workpiece 4, FIG. 3, such as a can body, from a generally cylindrical supporting device 6, such as a punch in a can body making machine. A support frame 8 is mounted at a fixed location adjacent to can forming and ironing dies (not shown). An annular base support 10 is mounted on the support frame 8 and has a radially inner portion 12. A plurality of circumferentially spaced apart guide members 14 project axially outwardly from the radially inner portion 12. A support surface 16 is located between adjacent guide members 14.

A stripping finger 20 is mounted in a cantilever manner for sliding movement over each support surface 16 in radial and linear directions. Resilient means, such as a coiled spring 22, urge the stripping fingers 20 in a radial inward direction to move the end portions 24 of the stripping fingers 20 into a location for stripping the generally cylindrical workpiece 4 from the generally cylindrical supporting device 6. The end portions 24 preferably are arcuately shaped. Abutment means 26, such as an abutment surface 27 on the radially inner portion 12 and an abutment surface 28 on each of the stripping fingers 20 are provided for assembly purposes and for limiting the inward movement of the stripping fingers 20. In some instances, the stripping fingers 20 contact the outer surface of the generally cylindrical supporting device 6 and therefore, the abutment surfaces do not come into contact with each other.

An electromagnetic coil 30 is mounted in an annular recess 32 in the annular base support 12. An annular retaining member 34 is mounted in the annular base support 12 and comprises an inner ring 36 formed from a non-magnetic material (not capable of being magnetized) and an outer ring 38 formed from a magnetic material (capable of being magnetized). The ends 40 of the coiled springs 22 are in contact with the inner ring 36 and an abutment surface 41 and an opening 43 in each of the fingers 20 to urge the stripping fingers 20 in a radially inward direction. An annular cover 42 has openings 44 to be aligned with openings 46 in the annular base support 12 so that the cover 40 may be secured to the annular base support 12 by conventional means (not shown). Electrical leads 48 are provided for energizing the electromagnetic coil 30. The annular base support 12 and the stripping fingers 20 are formed from a magnetic material. The cover 42 is formed from a non-magnetic material. In some instances, the electromagnetic coil 30 could be located where the outer ring 38 is located.

Figure 1:
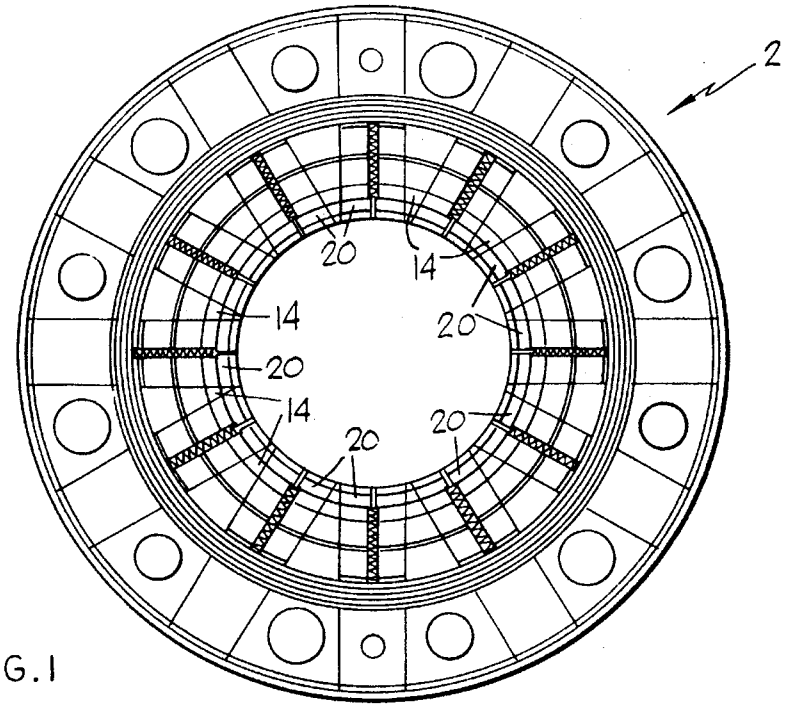
FIG. 1 is a top plan view of one preferred embodiment of the invention with parts removed and illustrating the springs.
Figure 2:
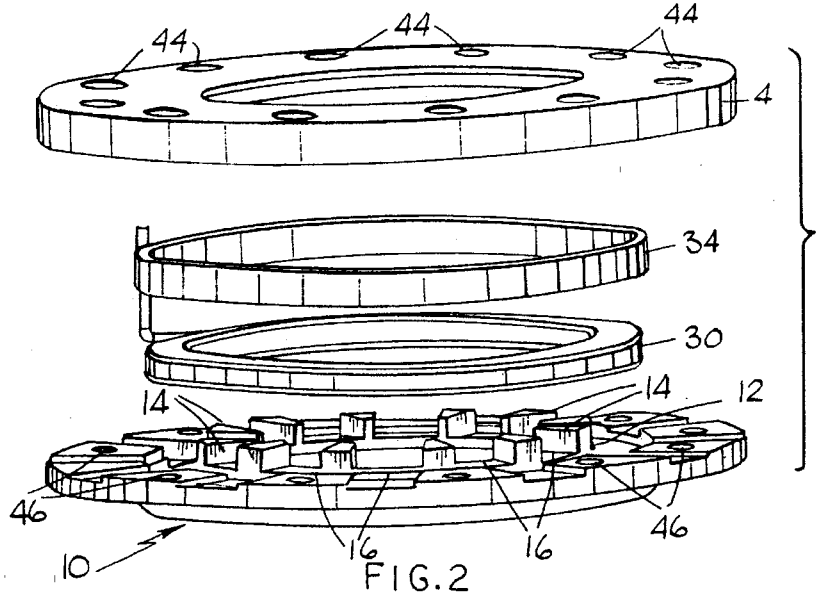
FIG. 2 is an exploded view of various components of the invention.

In operation, the electromagnetic coil is energized to move the stripping fingers 20 against the inner ring 36, FIG. 1, so that the generally cylindrical workpiece 4 and the generally cylindrical supporting device 6 may pass therethrough without contact with the stripping fingers 20. On the return stroke of the generally cylindrical supporting device, indicated by the arrow 50, the electromagnetic coil is deenergized and the coiled springs 22 move the end portions 24 of the stripping fingers 20 against or adjacent to the outer surface of the generally cylindrical supporting device 6 so that the leading end surface 52 of the generally cylindrical workpiece 4 contacts the end portions 24 to remove the generally cylindrical workpiece 4 from the generally cylindrical supporting device 6. As illustrated in FIG. 2, when the fingers 20 are in contact with the cylindrical supporting device 6, the abutment surface 27 and 28 are in a spaced apart relationship.

Figure 4:
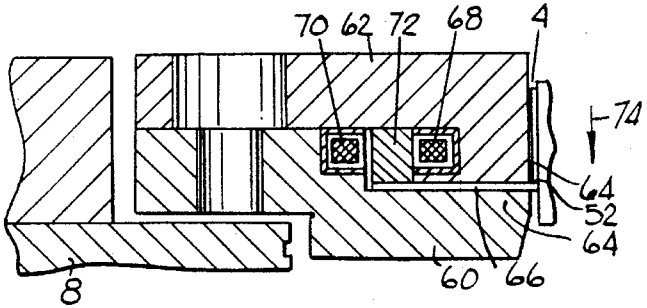
FIG. 4 is a view with parts in section of another preferred embodiment of the invention.

Another preferred embodiment of the invention is illustrated in FIG. 4. An annular base support 60 is mounted on the support frame 8. An annular cover 62 is mounted on the annular base support 60 and a plurality of circumferentially spaced apart channels 64 provide for sliding movement of stripping fingers 66 in radial and linear directions. A radially inner electromagnetic coil 68 and a radially outer electromagnetic coil 70 are mounted on the annular base support 60. A block 72 formed from a magnetic material is secured on each of the stripping fingers 66 and is located between the radially inner and outer electromagnetic coils 68 and 70.

In operation, the radially outer electromagnetic coil 70 is energized to attract each block 72 to move the stripping fingers 66 in a radially outward direction to permit the generally cylindrical workpiece 4 and the generally cylindrical supporting device 6 to pass therethrough without contacting the stripping fingers 66. On the return stroke of the generally cylindrical supporting device 6, indicated by the arrow 74, the radially outer electromagnetic coil 70 is deenergized and the radially inner electromagnetic coil 68 is energized to attract the blocks 72 and move the stripping fingers 66 in a radially inward direction against or adjacent to the outer surface of the generally cylindrical supporting device 6 so that the leading end surface 52 of the generally cylindrical workpiece 4 contacts the stripping fingers 66 to remove the generally cylindrical workpiece 4 from the generally cylindrical supporting device 6.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for stripping a cylindrical workpiece from a cylindrical supporting device on which the cylindrical workpiece is supported so that the cylindrical workpiece has a leading end surface during the return stroke of the cylindrical supporting device comprising:

housing means for supporting the apparatus circumjacent the cylindrical workpiece and the cylindrical supporting device;

a plurality of fingers for stripping said cylindrical workpiece from said cylindrical supporting device;

mounting means for mounting each of said plurality of fingers for sliding movement that is radial and linear;

each of said plurality of fingers having an end portion so that, when said plurality of fingers are in their radially innermost location, said plurality of fingers are at a location to be contacted by said leading end surface to remove said cylindrical workpiece;

abutment means on each of said fingers and on said housing to limit the radially inward movement of said plurality of fingers;

first moving means for moving each of said plurality of fingers in a radially inward direction;

said stripping fingers, when in said radially innermost location, are in contact with the outer surface of said generally cylindrical supporting device and said abutment means are in a spaced apart relationship;

second moving means for moving each of said plurality of fingers in a radially outward direction; and guide means between and in contact with adjacent fingers for guiding the movement of said fingers in said radially inward and outward directions.

2. Apparatus as in claim 1 wherein:

said first moving means comprise resilient means.

3. Apparatus as in claim 1 wherein said mounting means comprise:

an annular base support;

said annular base support having a radially inner portion;

said guide means comprise a plurality of circumferentially spaced apart guide members projecting axially outwardly from said radially inner portion;

a support surface between adjacent pairs of said guide members; and one of said plurality of fingers positioned for sliding movement in radial linear directions on each support surface.

4. Apparatus as in claim 2 and further comprising:

a recess formed in said annular base support; and an electromagnetic coil mounted in said recess.

5. Apparatus as in claim 2 wherein:

said second moving means comprise an electromagnetic means.

6. Apparatus as in claim 3 wherein said abutment means comprise:

an abutment surface on said radially inner portion; and an abutment surface on each of said plurality of fingers.

7. Apparatus as in claim 6 wherein:

said first moving means comprise resilient means.

8. Apparatus as in claim 7 wherein:

said second moving means comprise an electromagnetic means.

9. Apparatus as in claim 7 wherein:

said resilient means comprise a coiled spring mounted in an opening having an abutment surface in each of said plurality of fingers.

10. Apparatus as in claim 4 wherein:

said fingers and said annular base support are formed from a magnetic material.

11. Apparatus as in claim 10 wherein said mounting means comprise:

an annular base support;

said annular base support having a radially inner portion;

said guide means comprise a plurality of circumferentially spaced apart guide members projecting axially outwardly from said radially inner portion;

a support surface between adjacent pairs of guide members; and one of said plurality of fingers positioned for sliding movement in radial linear directions on each support surface.

12. Apparatus as in claim 11 wherein said abutment means comprise:

an abutment surface on said radially inner portion; and an abutment surface on each of said plurality of fingers.

13. Apparatus as in claim 12 and further comprising:

an annular retaining member mounted on said annular base support for contact by said coiled springs to urge said plurality of fingers in a radially inward direction; and a cover secured to said annular base support.

14. Apparatus as in claim 13 wherein said retaining member comprises:

an inner ring formed from a non-magnetic material; and an outer ring formed from a magnetic material.

15. Apparatus as in claim 1 wherein:

said first moving means comprise electromagnetic means; and said second moving means comprise electromagnetic means.

16. Apparatus as in claim 15 wherein:

said stripping fingers, when in said radially innermost location, are in contact with said generally cylindrical supporting device.

17. Apparatus as in claim 15 wherein:

said stripping fingers, when in said radially innermost location, are adjacent said generally cylindrical supporting device.

* * * * *